United States Patent [19]

Dakin et al.

[11] 4,142,831

[45] Mar. 6, 1979

[54] LIQUID-COOLED TURBINE BUCKET WITH ENHANCED HEAT TRANSFER PERFORMANCE

[75] Inventors: James T. Dakin, Schenectady; Kenneth A. Darrow, Sprakers; Myron C. Muth, Amsterdam, all of N.Y.

[73] Assignee: General Electric Company, Schenectady, N.Y.

[21] Appl. No.: 806,739

[22] Filed: Jun. 15, 1977

[51] Int. Cl.[2] ..... F01D 5/08

[52] U.S. Cl. ..... 416/96 A; 416/97 R

[58] Field of Search ..... 416/96–97, 416/95, 92; 165/184, 168, 109 T; 138/35

[56] References Cited

U.S. PATENT DOCUMENTS

| | | | |
|---|---|---|---|
| 1,777,782 | 10/1930 | Bundy | 416/96 A X |
| 3,856,433 | 12/1974 | Grondahl et al. | 416/97 |

FOREIGN PATENT DOCUMENTS

| | | | |
|---|---|---|---|
| 497230 | 10/1953 | Canada | 416/96 |
| 76797 | 12/1953 | Denmark | 416/96 A |
| 981599 | 5/1951 | France | 416/96 A |

*Primary Examiner*—Everette A. Powell, Jr.

*Attorney, Agent, or Firm*—Leo I. MaLossi; Joseph T. Cohen; Charles T. Watts

[57] ABSTRACT

Individual coolant passages in the airfoil portion of a liquid-cooled turbine bucket are each provided with a plurality of inwardly protruding circumferentially-extending crimps or rings located at spaced intervals along each passage, each crimp, protrusion or ring extending along the inner periphery in a plane generally perpendicular to the wall of the coolant passage at that location. The main flow of liquid coolant moving in each such individual passage during turbine operation under the combined influence of centrifugal and Coriolis forces is broken up and dispersed over an enlarged area of the interior of the coolant passage upon encountering the protrusions.

9 Claims, 3 Drawing Figures

LIQUID-COOLED TURBINE BUCKET WITH ENHANCED HEAT TRANSFER PERFORMANCE

BACKGROUND OF THE INVENTION

General teachings for the open-circuit liquid cooling of gas turbine vanes are set forth in U.S. Pat. Nos. 3,446,481 — Kydd; 3,619,070 — Kydd; 3,658,439 — Kydd; 3,816,022 — Day; and 3,856,433 — Grondahl et al., for example. In these patents, the cooling of the vanes, or buckets, is accomplished by means of a large number of spanwise-extending subsurface cooling passages.

The invention described and claimed herein is applicable in those constructions of liquid cooled buckets wherein the coolant passages are cylindrical in configuration. Thus, for example, preformed tubes employed as coolant passages preferably form a setting for the use of the instant invention. However, the concept of employing preformed tubes as subsurface coolant passages in turbine buckets, per se, as well as particular arrangements for incorporating such tubes in the bucket construction are the invention of other(s). Thus, the use of preformed tubes set in a copper matrix is shown in U.S. patent application Ser. No. 749,719 — Anderson, filed Dec. 13, 1976, and assigned to the assignee of the instant invention.

Tests made on open-circuit water cooled buckets with the axis of each coolant passage oriented approximately perpendicular to the turbine axis of rotation have established that under preferred conditions of operation (e.g., rate of water input, rotating speed, temperature of motive fluid, etc.) the water travels in a thin film through each passage. The water film is pulled through each channel by centrifugal force, achieving high radial velocity. At the same time, the film experiences a strong Coriolis force, which, at operational rates of cooling water supply, pushes the film into a limited area extending along the length of the coolant passage disposed the most rearwardly as the coolant passage is rotated.

When this occurs, the liquid film covers but a small fraction of the surface area of the coolant passage and the cooling capacity of the liquid flow is reduced. For a given heat flow into each coolant passage, or channel, this limited cooling area results in a higher coolant channel surface temperature and this in turn results in a higher bucket skin temperature and shortened bucket life. It would be most desirable to increase the effective cooling area within each coolant passage at any given rate of liquid coolant flow whereby the bucket skin temperature can be reduced and the cyclic fatigue life extended.

The invention described and claimed in U.S. patent applications Ser. No. 743,272 — Kydd, filed Nov. 19, 1976 now abandoned; Ser. No. 743,271 — Dakin et al., filed Nov. 19, 1976; and Ser. No. 780,292 — Dakin et al. (now U.S. Pat. No. 4,090,810), filed Mar. 23, 1977 (all assigned to the assignee of the instant invention) are directed to this same problem. In the Kydd application means (e.g., raised or recessed helical configurations) are provided within individual coolant passages for providing a swirling motion to the liquid coolant. In this manner the liquid coolant is subjected during operation to a first centrifugal force acting in the radial direction, the Coriolis force and a second centrifugal force acting about an axis extending in the general direction taken by the coolant passage.

In the Dakin et al. application '271, cylindrically-shaped coolant passages for liquid-cooled turbine buckets are converted into at least two helical sub-passageways by flow splitting means introduced into individual coolant passages and fixed in place as by brazing or tight mechanical fit. In addition each flow splitting, or flow modifying, means is provided with means disposed therealong for interrupting the liquid flow in each helical sub-passageway.

In the Dakin et al. application '292, a plurality of oriented spanning elements are affixed in and extend across each coolant passage.

Various vortex flow promoters in single phase stationary systems have been described in an article by A. E. Bergles in *Progress in Heat and Mass Transfer,* Volume I, Edited by V. Grigull and E. Hahne [Pergamon Press, 1969]. In stationary systems the cooling fluid is forced through a channel by a pressure drop and the vortex promotion is accomplished at the expense of increased pump power. No discussion or guidance is provided therein of any solution to the problem of increasing the effective cooling area within coolant passages in a rotating system.

DESCRIPTION OF THE INVENTION

Individual coolant passages in the airfoil portion of a liquid-cooled turbine bucket are each provided with a plurality of circumferentially-extending crimps, or protrusions, located at spaced intervals along each coolant passage, each protrusion extends along the inner periphery of the coolant passage over an arcuate length of at least about 120° being disposed in a plane generally perpendicular to the wall of the coolant passage at that location. The flow of liquid coolant moving in each such coolant passage during operation of the turbine under the influence of centrifugal force is broken up and dispersed upon encountering the protrusions thereby contacting a larger area of the interior of the coolant passage.

BRIEF DESCRIPTION OF THE DRAWING

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying drawing wherein:

MANNER AND PROCESS OF MAKING AND USING THE INVENTION

Figure 1:
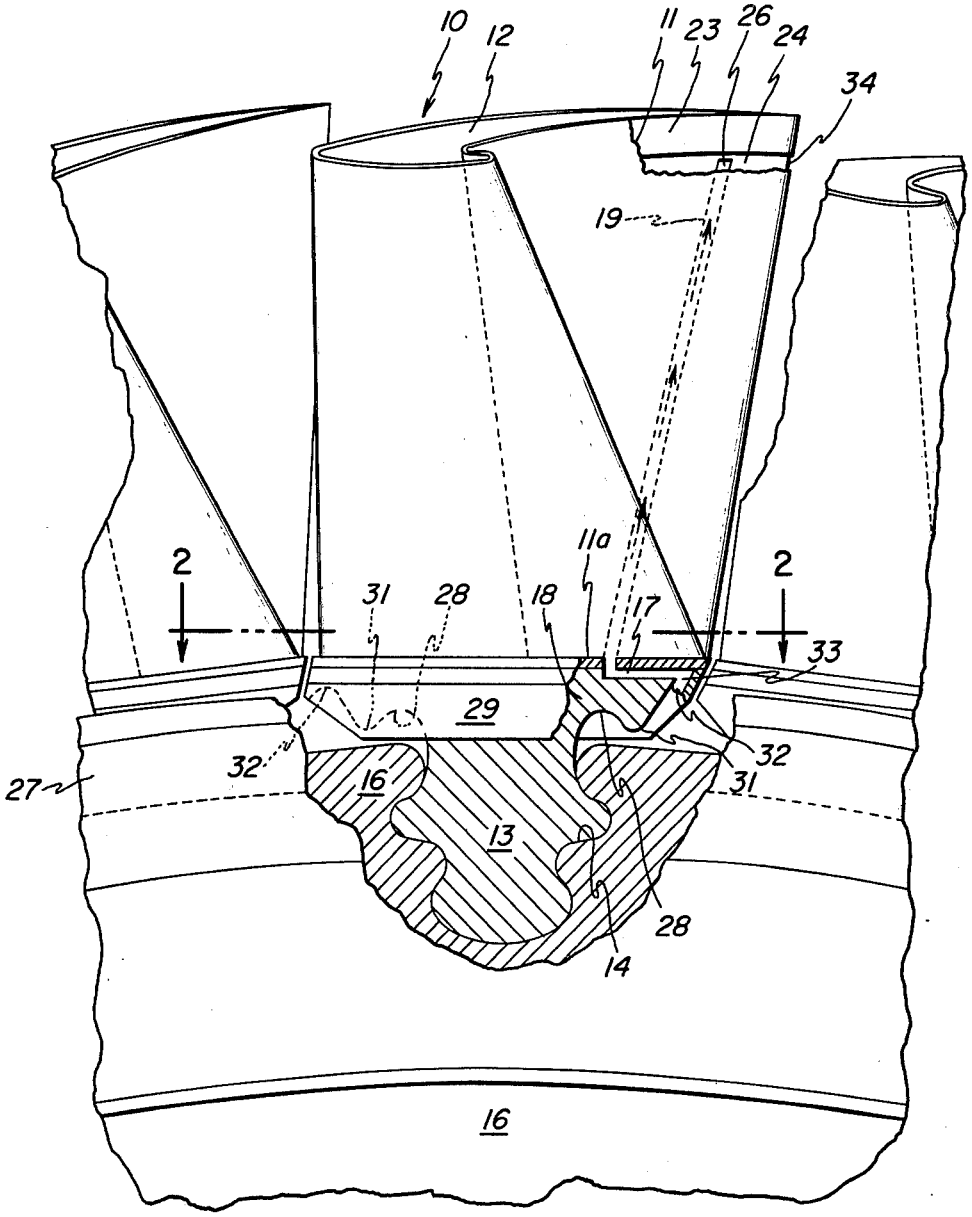
FIG. 1 is a view partially in section and partially cut away showing root, platform and airfoil-shaped portions of a liquid-cooled turbine bucket.
Figure 2:
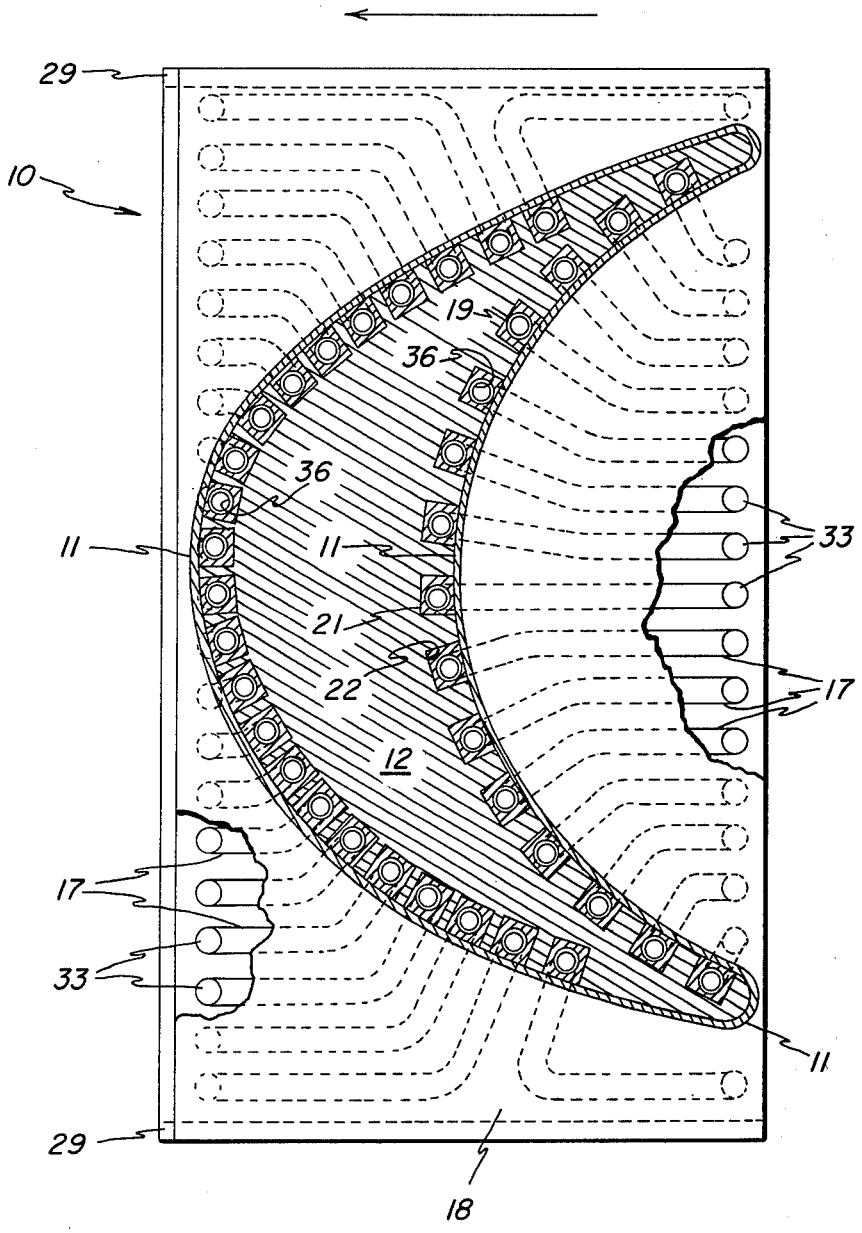
FIG. 2 is a view taken on line 2—2 of FIG. 1 with the platform skin removed in part showing the preferred embodiment of this invention.

The particular type of bucket construction shown in FIGS. 1 and 2 and described herein is merely exemplary and the invention is broadly applicable to open-circuit liquid-cooled turbine buckets equipped with sub-surface coolant passages of substantially circular transverse cross-section.

The turbine bucket 10 shown consists of skin 11, 11*a*, preferably of a heat- and wear-resistant material, affixed to a unitary bucket core 12 (i.e., root/platform/airfoil). Root portion 13, as shown, is formed in the conventional dovetail configuration by which bucket 10 is retained in slot 14 of wheel rim 16. Each groove 17 recessed in the surface of platform portion 18 is connected to and in flow communication with tube member 19 set in a metallic matrix 21 of high thermal conductivity in a recess, e.g., slot 22 in the surface of airfoil portion 23 of core 12. The airfoil portion 23 together with skin 11 comprises the airfoil portion of bucket 10. If desired, of course, sub-surface coolant passages 19 may be in the form of preformed tubes set into recessed grooves in skin 11. The general arrangement of coolant passages recessed in the airfoil skin is shown in U.S. Pat. No. 3,619,076 referred to hereinabove. As has been previously stated, the use of and arrangement of preformed tubes as coolant passages, per se, is the invention of another.

Liquid coolant is conducted through the coolant passages at a substantially uniform distance from the exterior surface of bucket 10. At the radially outer ends of the coolant passages 19 on the pressure side of bucket 10, these passages are in flow communication with, and terminate at, manifold 24 recessed into airfoil portion 23. On the suction side of bucket 10 the coolant passages, or channels, are in flow communication with, and terminate at, a similar manifold (not shown) recessed into airfoil portion 23. Near the trailing edge of bucket 10 a cross-over conduit (opening shown at 26) connects the manifold on the suction side with manifold 24. Open-circuit cooling is accomplished by spraying cooling liquid (usually water) at low pressure in a generally radially outward direction from nozzles (not shown) mounted on each side of the rotor disk. The coolant is received in an annular gutter, not shown in detail, formed in annular ring member 27, this ring member and the flow of coolant to and from the gutter is more completely described in the aforementioned Grondahl et al. patent, incorporated by reference.

Liquid coolant received in the gutters, is directed through feed holes (not shown) interconnecting the gutters with reservoirs 28, each of which extends in the direction parallel to the axis of rotation of the turbine disk.

The liquid coolant accumulates to fill each reservoir 28 (the ends thereof being closed by means of a pair of cover plates 29). As liquid coolant continues to reach each reservoir 28, the excess discharges over the crest of weir 31 along the length thereof and is thereby metered to the one side or the other of bucket 10.

Coolant that has traversed a given weir crest 31 continues in the generally radial direction to enter longitudinally-extending platform gutter 32 as a film-like distribution, passing thereafter through the coolant channel feed holes 33. Coolant passes from holes 33 to manifold 24 (and suction manifold, not shown) via platform and vane coolant passages.

As the coolant traverses the sub-surfaces of the platform portion and of the airfoil portion, these portions are kept cool with a quantity of the coolant being converted to the gaseous or vapor state as it absorbs heat, this quantity depending upon the relative amounts of coolant employed and heat encountered. The vapor or gas and any remaining liquid coolant exit from the manifold 24 via opening 34, preferably to enter a collection slot (not shown) formed in the casing for the eventual recirculation or disposal of the ejected liquid.

The amount of coolant admitted to the system for transit through the coolant passages may be varied and in those instances in which minimum coolant flow and high heat flux prevail, objectionable dry-out of the coolant passages may be encountered.

Figure 3:
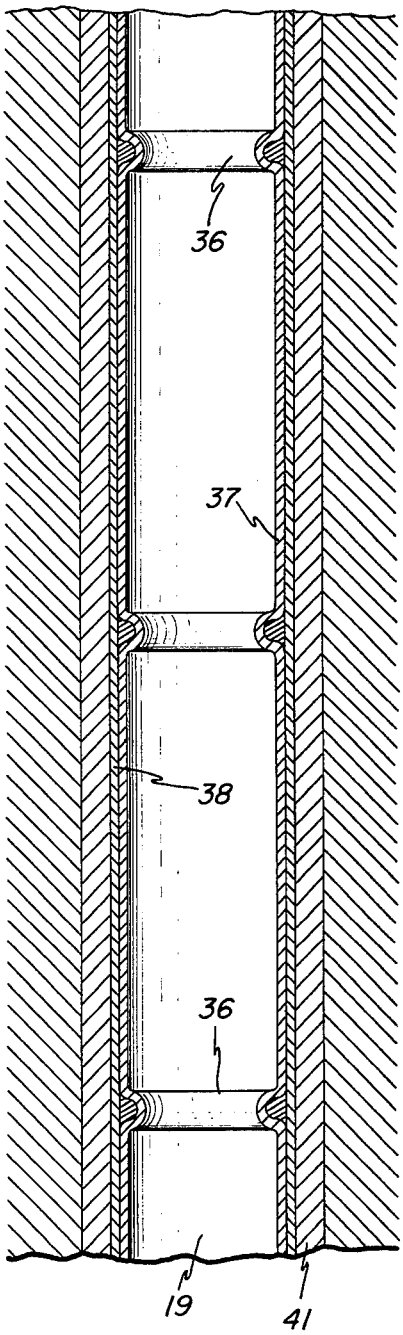
FIG. 3 is a longitudinal section taken along any of the coolant passages of FIG. 2.

In the practice of this invention (as illustrated generally in FIGS. 2 and 3) the interiors of all, or selected, coolant passages 19 in a liquid-cooled turbine bucket 10 may be provided with a series of ring-like protrusions located at intervals and extending around the open channel as shown. By disposing protrusion 36 completely around the inner periphery of passage 19 contact with cooling liquid is assured as the liquid makes its way along the cooling passage under the influence of the Coriolis force. Thus, with each protrusion 36 extending completely around the inner periphery as shown, there is no need for aligning the protrusions in the coolant passages 19 in any particular manner during manufacture of the bucket. Minimal alignment is required, if the arcuate length of the protrusion is at least about 180°. Such alignment is readily accomplished. Protrusions having an arcuate length of less than 180° (but greater than about 120°) can be located so that they will be in a stacked arrangement spaced along an element of the generally cylindrically-shaped coolant passage (or tube therefor). Alignment in bucket manufacture merely comprises disposing the stack of protrusions so that the stack is located along the most rearward portion of the coolant passage during rotation of the bucket. The longer the arc length of the protrusions, the easier it is to accomplish this alignment. When the protrusions are so situated, as coolant liquid makes its way along the coolant passage it will encounter these protrusions.

Proceeding from the radially inward end of airfoil portion 23 in each coolant passage 19 a series of spaced arcuate protrusions 36 are shown as deformed portions of wall 37. These arcuate protrusions (shown as rings) are arranged in parallel relation to each other in FIG. 3, but this is not critical. The spacing thereof is also not critical and may, for example, range from about 2 to about 6 times the inner diameter of the tubes 19. The preferred range of spacings is 3–4 diameters. Preferably, the protrusions 36 are formed with the curvature of the crimp in an approximately semi-circular shape (as shown in section in FIG. 3) by deforming wall 37 thereby leaving a semi-circular recess therebehind.

The circumferentially-extending crimps, or protrusions, 36 may be impressed in the tube 37 by either inward or outward deformation of appropriate wall portions, e.g., as by an explosive-forming process. Alternatively, protrusions can be formed as separate elements and later be affixed to the inner surface of wall 37. The thickness of wall material 36 may range from about 5–10 mils, the larger thickness being preferred, if the wall is to be deformed.

Thus, as liquid coolant enters each tube member 19 and is pulled through this channel by centrifugal force as a thin film, even though a strong Coriolis force acts upon the film and pushes it to the rearwardmost (relative to the direction of rotation) region of the tube 19, the film so constrained must still encounter each circumferentially-extending protrusion 36 disposed according to the teachings of this invention in its outward movement. Contact between the liquid film and each protrusion 36 produces sufficient continuous splashing action to overcome the Coriolis segregation of some of the liquid in the film thereby widening the area of contact between liquid coolant and the inner wall of tube 19 along the length thereof. This results in a significant increase in the effectiveness of the liquid cooling mechanism.

The inward extent of each protrusion, or ridge, 36 (as viewed in FIG. 2) must not be so large as to impede the movement of steam along passage 19. Usually one would not want to block more than about 50% of the area of the transverse cross-section of passage 19 and leave the core of the passage open. In some constructions passages 19 may not be strictly cylindrical in shape, because it may be necessary to bend otherwise cylindrical tubes to conform to bucket contours.

Tests at a series of temperatures ranging from about 100° F. to 400° F. were conducted on a tubular assembly manufactured as follows: first, an annealed 347 stainless steel tube 37 (0.125 inch O.D., 0.010 inch wall thickness) was deformed to introduce inwardly projecting rings 36 into the tube wall spaced apart about 3 tube diameters; second, a length of copper wire was wrapped around tube 37 in each recess behind the protrusion 36 and tube 37 was then silver-plated over its outer surface; third, a length of copper tubing 38 (⅛inch I.D., ¼inch O.D.) was drawn over the silver-plated, steel tube 37 in the process of which the copper filler wires were deformed to fill each recess; and, next, the two tubes were metallurgically bonded together by firing in a dry hydrogen furnace. Finally, the unit so assembled was brazed into a copper block in which Calrod® heaters were also embedded. The tube composite was disposed at an angle to the radial direction in order that during the tests to be described hereinbelow the copper block when rotated would present the composite tubing at two different tilt orientations, when rotated in opposite directions.

A similar composite tube construction without projections 36 (plain-passage) was prepared and embedded in a similar manner in a copper block provided with the requisite heater units. Still another configuration was tested to provide comparative data. In this last configuration a tube assembly using the same materials and dimensions as in the previous two constructions was prepared. However, in place of circumferentially-extending protrusions 36 as in the first construction, a plurality of point, or conical, dimples were introduced into stainless steel tube 37 projecting inwardly of the tube and arranged in a relatively uniform spacing about the circumference and along the length of the tube in a generally helical configuration. The point dimples were located approximately one tube diameter apart. In place of the copper wires employed in the first construction to fill the recesses behind the dimples, copper was flame sprayed into these depressions on the outside of the deformed stainless steel tube. Otherwise, the assembly procedure was identical as described herein for the first configuration.

Each copper block assembly containing its particular coolant passage configuration was then tested to determine its heat transfer performance in a gas-turbine-like environment. Each block assembly was placed in the pay-load section of a motorized test rig and rotated at 3600 RPM, 22 inches from the axis of rotation. The centrifugal force field on the block assembly was comparable to that on a turbine bucket in an industrial gas turbine. Heat was applied to each block assembly at a measured rate by means of the Calrod® heaters. Water was passed through the coolant passage during rotation and measurements were made of the temperature of the water (the coolant) entering the block to pass through the coolant passage and the temperature of the copper block was also measured with thermocouples so as to determine the effectiveness of the cooling action.

The measurements of the copper block temperatures were coordinated with the amount of heat introduced into the copper block (Calrod® heater power). The results of these tests were plotted and compared. In a typical gas turbine application, a coolant passage of the length employed in the test (5 inches) might be expected to remove 2600 watts of heat from the adjacent bucket surface with the copper at a temperature 200° F. hotter than the water saturation temperature (i.e., 212° F. for these data). When this design goal was located on the aforementioned plot, it was found that the data for the first composite tube construction (i.e., that configuration employing circumferential projections 36) extrapolated rather close to the desired goal. Another advantage of utilizing projections 36 is the fact that the data proved to be insensitive to the orientation of the coolant passage with respect to the radial direction (i.e., the particular tilt).

In contrast thereto, the performance of the point dimpled coolant passage was very poor. This poor performance could have been due either to a faulty copper-to-stainless steel bond or to some intrinsic drawback to this particular construction. For instance, the narrow Coriolis stream of water may have merely channeled around the small proportion of point dimples, which it encountered. The copper block assembly utilizing the plain-passage construction was considerably less desirable than the construction employing projections 36. Thus, the plain-passage data extrapolated to higher copper temperatures at the design heat input and the data also showed considerable tilt-sensitivity. Subsequent data for the plain-passage has shown devastating burn-out behavior at a heater power input of 2000 watts. A separate construction utilizing nickel lining in place of the stainless steel lining shown burn-out behavior for the plain-passage construction at a heater power input of 1300 watts.

Stainless steel tubes provided with the requisite circumferential crimps 36 can be readily manufactured by utilizing rolling or stamping operations or explosive-forming.

The use of the aforementioned materials, shapes and sizes are merely illustrative and many variations thereof can readily be prepared by the technician utilizing the teachings set forth herein.

The term "bucket" as used in this specification is intended to include all rotating turbomachinery blades.

BEST MODE CONTEMPLATED

The construction proposed for the best mode utilizes ring-like protrusions 36 as shown. Thus, the arcuate length of these protrusions is to encompass the full 360°, or as close to 360° as is possible with the particular process employed for establishing the arcuate protrusion construction. Materials to be utilized would be as follows:

tube 37 . . . stainless steel (A-286 or In-718)
embedment 21 for tubes. . . copper powder densified in situ For ease of manufacture the curvature for the projecting portion is made approximately semi-circular in cross-section and the spacing between arcuate projections is 3–4 tube diameters.

What we claim as new and desire to secure by Letters Patent of the United States is:

1. In liquid-cooled turbine bucket construction comprising an airfoil-shaped portion, a platform portion and a root portion, wherein said root portion is specifically shaped for engaging a rotor structure for rotation of said bucket in a predetermined planar direction and at least said airfoil-shaped portion has a plurality of subsurface coolant passages extending along the pressure and suction faces thereof, the improvement comprising:

said coolant passages extending spanwise of said airfoil-shaped portion;

a plurality of arcuate portions extending circumferentially along and projecting inwardly from the inner periphery of the wall of an individual coolant passage, each of said projecting portions having an arcuate length of at least about 120° and being spaced from adjacent projecting portions with each of said projecting portions lying substantially in a separate plane generally perpendicular to the wall of said coolant passage at the given station therealong, the extent and inward projection of each of said projecting portions being such as to block less than 50 percent of the area of the transverse cross-section of said individual passage with the core of said individual passage remaining open.

2. The improved liquid-cooled turbine bucket as recited in claim 1 wherein the projecting portions are regions of the deformed wall of the coolant passage.

3. The improved liquid-cooled turbine bucket as recited in claim 2 wherein the coolant passage wall is tubular and is encapsulated in copper.

4. The improved liquid-cooled turbine bucket as recited in claim 1 wherein the arcuate length of each of the projecting portions is between about 120° and about 180° and all said projecting portions are in stacked alignment.

5. The improved liquid-cooled turbine bucket as recited in claim 1 wherein the arcuate length of each of the projecting portions is at least about 180°.

6. The improved liquid-cooled turbine bucket as recited in claim 1 wherein the arcuate length of each of the projecting portions is substantially 360°.

7. The improved liquid-cooled turbine bucket as recited in claim 1 wherein the projecting portion curvature is approximately semi-circular in cross-sectional shape.

8. The improved liquid-cooled turbine bucket as recited in claim 1 wherein the projecting portions in a given coolant passage are spaced apart a distance in the range of from about 2 to about 6 coolant passage diameters.

9. The improved liquid-cooled turbine bucket as recited in claim 7 wherein the spacing of the projecting portions is in the range of from about 3 to about 4 coolant passage diameters.

* * * * *